US006257446B1

(12) United States Patent
Pike

(10) Patent No.: US 6,257,446 B1
(45) Date of Patent: Jul. 10, 2001

(54) LIQUID CHEMICAL CONTAINER WITH INTEGRATED FLUID RESERVOIR

(75) Inventor: Christopher L. Pike, Fremont, CA (US)

(73) Assignee: Advanced Micro Devices, Inc., Sunnyvale, CA (US)

( * ) Notice: Subject to any disclaimer, the term of this patent is extended or adjusted under 35 U.S.C. 154(b) by 0 days.

(21) Appl. No.: 09/252,429

(22) Filed: Feb. 18, 1999

(51) Int. Cl.[7] ..... B67D 5/08
(52) U.S. Cl. ..... 222/52; 222/464.7
(58) Field of Search ..... 222/464.7, 95, 222/400.7, 394, 66, 52

(56) References Cited

U.S. PATENT DOCUMENTS 3,171,571 * 3/1965 Daniels ..... 222/464.7
3,360,168 * 12/1967 Bret .
3,419,193 * 12/1968 Stewart et al. ..... 222/464.7
4,700,870 * 10/1987 Schleicher et al. ..... 222/63
4,759,475 * 7/1988 Munthe ..... 222/464.7
5,275,313 * 1/1994 Petrillo et al. ..... 222/464.7
5,366,119 * 11/1994 Kline ..... 222/464.7
5,558,252 * 9/1996 Stapensea et al. ..... 222/464.7
5,660,201 * 8/1997 Turner ..... 222/148
5,749,500 * 5/1998 Krause ..... 222/377
6,077,356 * 6/2000 Bouchard ..... 222/66

* cited by examiner

*Primary Examiner*—Steven O. Douglas
*Assistant Examiner*—Khoa D. Huynh
(74) *Attorney, Agent, or Firm*—Lariviere, Grubman & Payne, LLP

(57) ABSTRACT

A liquid dispenser system uses a container that has a reservoir in the bottom of the container and an opening in the top of the container. The dispenser has a cover, which covers the opening in the container and a draw tube that extends from the cover into the reservoir. An end of the draw tube in the reservoir has a plurality of inlets. The average cross-section of the reservoir below the inlets of the draw tube is less than one fourth of the average cross-section of the rest of the container. As a result of the difference in average cross-sections, the invention reduces the amount of liquid that the dispenser is not able to dispense, which reduces wasted liquid. In a production environment, the reduction in waste results in a reduction in down time.

14 Claims, 2 Drawing Sheets

LIQUID CHEMICAL CONTAINER WITH INTEGRATED FLUID RESERVOIR

FIELD OF THE INVENTION

The present invention relates to liquid containers. More particularly, the invention relates to a container that uses a dispenser mounted on the liquid container to dispense the liquid. More particularly the invention relates to liquid containers with top mounted dispensers where the container holds a removable bag which holds the liquid.

BACKGROUND OF THE INVENTION

Liquid containers with a built in dispenser often have a dispenser mechanism mounted at the top of the container. Top dispensers use a draw tube that extends to the bottom of the liquid container. Many such containers have a flat interior bottom. Once the level of the liquid goes below the bottom of the draw tube the dispenser is unable to dispense the remaining liquid, which is often disposed with the container. Accordingly, it is a primary object of the present invention to provide a container and dispenser that dispenses a larger percentage of liquid.

BRIEF SUMMARY OF THE INVENTION

Accordingly, the foregoing object is accomplished by providing a container such as a bottle with a reservoir at the bottom of the container and an extended draw tube that extends into the reservoir.

Other features of the present invention are disclosed or apparent in the section entitled: "DETAILED DESCRIPTION OF THE INVENTION."

BRIEF DESCRIPTION OF DRAWINGS

For fuller understanding of the present invention, reference is made to the accompanying drawings wherein.

Figure 2:
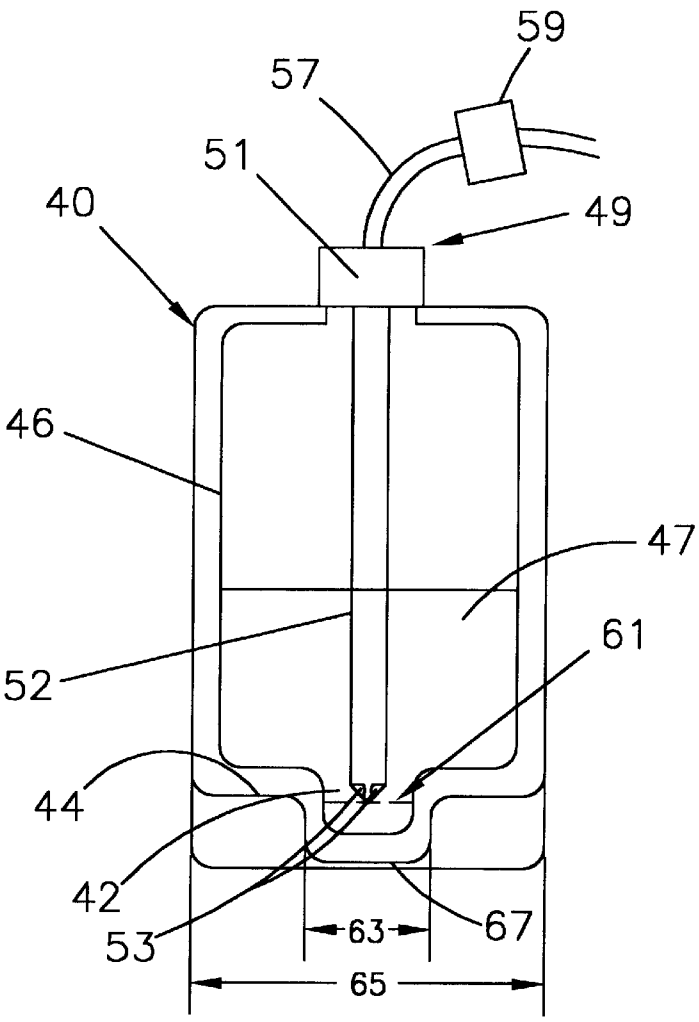
FIG. 2 illustrates a side view of a container with a dispenser in accordance with the principles of the present invention.

Reference numbers refer to the same or equivalent parts of the present invention throughout the several figures of the drawing.

DETAILED DESCRIPTION OF THE INVENTION

Figure 1:
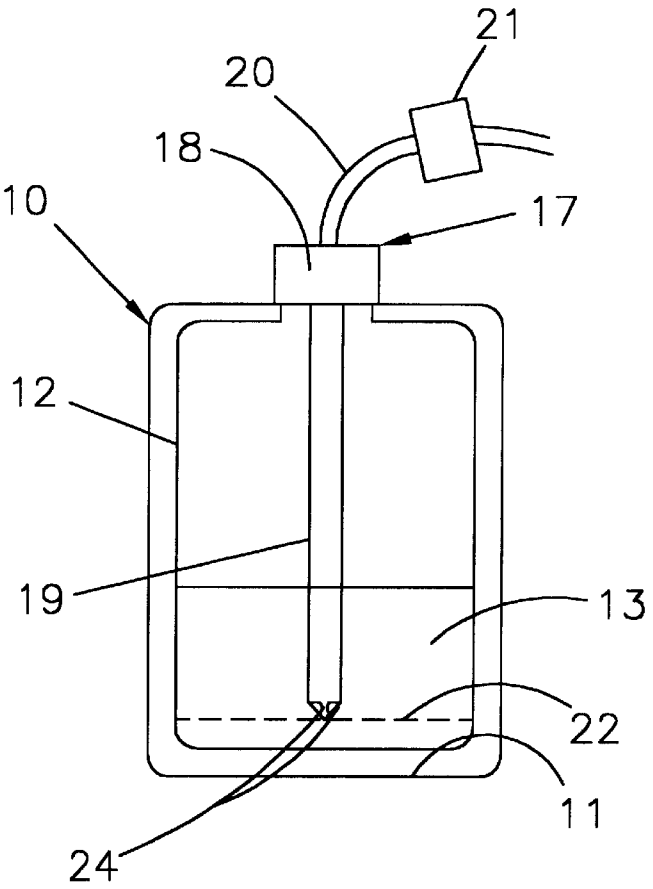
FIGURE. 1 (PRIOR ART)
FIG. 1 illustrates a side view of a prior art container with a prior art dispenser.

As briefly discussed above, and as shown in FIG. 1, in the prior art a container 10 with a flat interior bottom 11 is lined by a plastic bag 12, which contains a liquid 13. A dispenser 17 is placed over an opening in the top of the container 10 and into the container 10. The dispenser 17 comprises a cover 18 and a draw tube 19 extending from the cover 18 to near the interior bottom 11 of the container 10, where inlets 24 are placed near the bottom of the draw tube 19. The dispenser 17 may also have a fluid delivery tube 20, which is used in industrial production lines to provide fluid from the dispenser 17 to a production line.

In a production line, a bubble sensor 21 is connected to the delivery tube 20. The bubble sensor 21 is able to detect the presence of bubbles in the delivery tube 20 and either sounds an alarm or stops production when a bubble is detected. The dispenser 17 stops drawing liquid when the surface level of the liquid reaches a minimal surface level 22 determined by the depth of the draw tube 19. The container 10 is then removed from the dispenser 17, and a new container 10 with a new plastic bag are connected to the dispenser 17. The old plastic bag 12 is removed from the old container 10, and a new plastic bag 12 is placed in the old container 10. The remaining liquid in the old plastic bag 12 may be disposed with the plastic bag 12 causing a waste of liquid. The failure to use the large volume of remaining liquid causes more frequent stopping of production to change the containers, thereby increasing down time. Since many of these chemicals have a high cost of disposal, in addition to paying to purchase the wasted liquid, there is the additional payment to dispose of the wasted liquid. In addition, the large surface area near the bottom of the draw tube 19 increases the amount of bubbles when the surface of the liquid is just above the inlets 24 and the container 10 is disturbed, thereby causing the bubble sensor 21 to create more false alarms and which further increases down time.

FIG. 2 illustrates a container 40, used in a preferred embodiment of the invention, with a reservoir 42 formed by a concave portion of the interior of the bottom 44 of the container 40. In the preferred embodiment, the container 40 is a bottle, preferably a glass bottle or a plastic (polycarbonate) bottle. The container 40 is lined by a plastic bag 46, which contains a liquid 47. The exterior of the bottom 44 of the container 40 in this embodiment is flat. The bottom 44 of the container 40 is thick to allow the formation of the reservoir 42 on the interior part of the bottom 44, while keeping the exterior of the bottom 44 flat.

A dispenser 49 is placed over an opening in the top of the container 40 and into the container 40. The dispenser 49 comprises a cover 51 and a draw tube 52 with a first end and a second end opposite from the first end. The first end of the draw tube 52 is mechanically connected to the cover 51. The second end of the draw tube 52 is placed into the reservoir 42 of the container 40. Inlets 53 into the draw tube 52 are located near the second end of the draw tube 52 so that when the second end of the draw tube 52 is placed into the reservoir 42, the inlets 53 are placed into the reservoir 42. In the preferred embodiment, the dispenser 49 has a fluid delivery tube 57, which is used in industrial production lines to provide fluid from the dispenser 49 to a production line. The delivery tube 57 is mechanically connected to the cover 51 and is outside of the container 40 and is in fluid connection with the draw tube 52.

In a production line, a bubble sensor 59 is in fluid connection with the delivery tube 57. The bubble sensor 59 is able to detect the presence of bubbles in the delivery tube 57 and either sounds an alarm or stops production when a bubble is detected. The dispenser 49 stops drawing liquid when the surface level of the liquid reaches a minimum surface level 61 determined by the depth of the inlets 53 of the draw tube 52. The container 40 is then removed from the dispenser and a new container 40 is attached to the dispenser. The old plastic bag 46 is removed from the old container 40. The remaining liquid may be disposed with the old plastic bag 46.

In this embodiment the container 40 and reservoir 42 have round cross-sections, and thus have a diameter. If the container 42 and reservoir were square or had other shapes, the width would be used in place of the diameter. In the specification and claims, the term "width" also includes a diameter for objects with a round cross-section. The reservoir 42 has a width 63 that is less than ¼ of the width 65 of the remainder of the container 40. Therefore, the cross-sectional area of the reservoir 42 would be less than 1/16 of the cross-sectional area of the container 40. This would mean that the invention fails to dispense less than 1/16 of the liquid (by volume) that is not dispensed of in a prior art container if both containers have the same diameters and the inlets of the prior art container are spaced the same distance from the bottom of the container as the inlets in the preferred embodiment are spaced from the bottom of the reservoir, since the volume of the reservoir below the inlets in the invention is less than 1/16 the volume of the container below the inlets in the prior art. This reduction in waste also causes less frequent stopping of production to change the container decreasing down time. In addition, the small surface area near the bottom of the draw tube 52 decreases the amount of bubbles allowing for fewer false alarms from the bubble sensor 59 and thus further decreasing down time.

In the preferred embodiment, the reservoir has a lowest section 67, where the inlets 53 for the draw tube 42 are placed adjacent to the lowest section 67.

Figure 3:
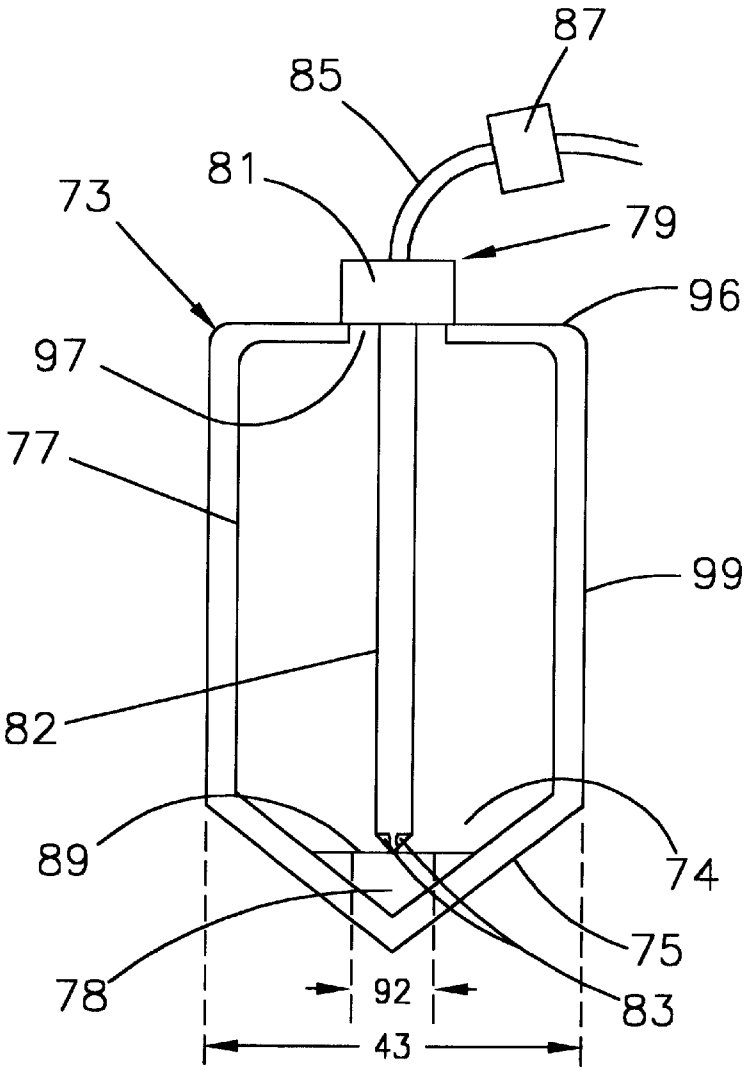
FIG. 3 illustrates a side view of another embodiment of a container with a dispenser in accordance with the principles of the present invention.

FIG. 3 illustrates a container 73, used in another preferred embodiment of the invention. The container 73 has a top 96 with an opening 97, a bottom 75, and a side wall 99 forming a tubular section extending from the top 96 to the bottom 75. A reservoir 74 is formed by a concave portion of the interior of the bottom 75 of the container 73. In the preferred embodiment, the container 73 is a bottle, preferably a glass bottle or a plastic bottle. The container 73 is lined by a plastic bag 77, which contains a liquid 78.

A dispenser 79 is placed over an opening in the top of the container 73 and into the container 73. The dispenser 79 comprises a cover 81 and a draw tube 82 with a first end and a second end opposite from the first end. The first end of the draw tube 82 is mechanically connected to the cover 81. The second end of the draw tube 82 is placed into the reservoir 74 of the container 73. Inlets 83 in the draw tube 82 are located near the second end of the draw tube 82 so that when the second end of the draw tube 82 is placed into the reservoir 74, the inlets 83 are placed into the reservoir 72. In the preferred embodiment, the dispenser 79 has a fluid delivery tube 85, which is used in industrial production lines to provide fluid from the dispenser 79 to a production line. The delivery tube 85 is mechanically connected to the cover 81 and is outside of the container 73 and is in fluid connection with the draw tube 82.

In a production line, a bubble sensor 87 is in fluid connection with the delivery tube 85. The bubble sensor 87 is able to detect the presence of bubbles in the delivery tube 85 and either sounds an alarm or stops production when a bubble is detected. The dispenser 79 stops drawing liquid when the surface level of the liquid reaches a minimum surface level 89 determined by the depth of the inlets 83 of the draw tube 82. The container 73 is then removed from the dispenser 79, and a new container 73 is attached to the dispenser 79. The old plastic bag 77 is removed from the old container 73. The remaining liquid may be disposed with the old plastic bag 77.

Because the reservoir 74 is tapered, as shown, the reservoir 74 has a varying width and therefore a varying cross-section. The volume of the of the remaining liquid when the surface level of the liquid reaches the minimum surface level 89 is the average cross-sectional area of the reservoir below the minimum surface level 89 times the height of the minimum surface level 89. The average cross-sectional area is a function of the average width of the reservoir 74 below the minimum surface level 89. When the tubular section formed by the side wall 99 has a round or square cross-sectional area the average cross-sectional area is related to the square of the average width. For the embodiment shown in FIG. 3, the container 73 and reservoir 74 have square cross-sectional areas. In addition, the tapered reservoir 74 has an average width below the minimum surface level 89, which is equal to a width 92 which is about half way between the minimum surface level 89 and the bottom of the container 73. The width 92 is less than 1/4 of the width 93 of the container 73. This would mean that the invention fails to dispense less than 1/16 of the liquid (by volume) than the volume of liquid that is not dispensed of in a prior art container if both containers have the same widths and the inlets of the prior art container are spaced the same distance from the bottom of the container as the inlets in the preferred embodiment are spaced from the bottom of the reservoir, since the volume of the reservoir below the inlets in the invention is less than 1/16 the volume of the container below the inlets in the prior art. This reduction in waste also causes less frequent stopping of production to change the plastic bag decreasing down time. In addition, the small liquid surface area near the bottom of the draw tube 52 decreases the amount of bubbles producing fewer false alarms from the bubble sensor 87 and thus further decreasing down time.

Since the exterior bottom of the container 73, in this embodiment, is not flat the container 73 is held in a support such as a cradle or stand that provides a stable placement of the container 73.

In other embodiments the ratio of the average cross-sectional area of the container above the reservoir to the average cross-sectional area of the reservoir below the inlets could be different that 16:1. Preferably the ratio would be greater than 4:1.

In the illustrated embodiments, the dispenser provides air into the plastic bag, so that the plastic bag maintains the shape of the container as the liquid is dispensed. In other preferred embodiments, the dispenser provides air to the container instead of the plastic bag, which causes the plastic bag to collapse from the container walls as the liquid is dispensed.

The present invention has been particularly shown and described with respect to certain preferred embodiments and features thereof. However, it should be readily apparent to those of ordinary skill in the art that various changes and modifications in form and detail may be made without departing from the spirit and scope of the inventions as set forth in the appended claims. The inventions illustratively disclosed herein may be practiced without any element which is specifically disclosed herein.

What is claimed is:

1. An apparatus for dispensing liquid, comprising:

a container, comprising;

a top with an opening;

a bottom spaced from the top;

a tubular section extending from the top of the container to the bottom of the container; and a reservoir formed by a concave section of the bottom of the container, said reservoir having an average cross sectional area, wherein the ratio between the average cross-sectional area of said reservoir to the average cross-sectional area of said container is greater than 4:1; and a dispenser, comprising:

a cover extending across the opening of the top of the container;

a draw tube extending from the cover into the reservoir; and inlets in a part of the draw tube in the reservoir.

2. The apparatus, as recited in claim 1, wherein the dispenser further comprises a delivery tube in fluid connection with the draw tube and outside of the container.

3. The apparatus, as recited in claim 2, further comprising a bubble sensor in fluid connection with the delivery tube.

4. The apparatus, as recited in claim 3, further comprising a bag lining the inside of the container.

5. The apparatus, as recited in claim 4, wherein the bag is a plastic bag.

6. The apparatus, as recited in claim 5, wherein the container has a round cross-section.

7. The apparatus, as recited in claim 5, wherein the container has a square cross-section.

8. An apparatus for dispensing liquid, comprising:

a container, comprising:

a top with an opening;

a bottom spaced from the top;

a tubular section extending from the top of the container to the bottom of the container, and a reservoir formed by a concave section of the bottom of the container, said reservoir having an average cross sectional area, wherin the ratio between the average cross-sectional area of said reservoir to the average cross-sectional area of said container is greater than 16:1; and a dispenser, comprising:

a cover extending across the opening of the top of the container;

a draw tube extending from the cover into the reservoir; and inlets in a part of the draw tube in the reservoir.

9. The apparatus, as recited in claim 8, wherein the dispenser further comprises a delivery tube in fluid connection with the draw tube and outside of the container.

10. The apparatus, as recited in claim 9, further comprising a bubble sensor in fluid connection with the delivery tube.

11. The apparatus, as recited in claim 10, further comprising a bag lining the inside of the container.

12. The apparatus, as recited in claim 11, wherein the bag is a plastic bag.

13. The apparatus, as recited in claim 12, wherein the container has a round cross-section.

14. The apparatus, as recited in claim 12, wherein the container has a square cross-section.

* * * * *